US006938567B1

(12) United States Patent
O'Donnell

(10) Patent No.: US 6,938,567 B1
(45) Date of Patent: Sep. 6, 2005

(54) MULTI-FUNCTIONAL SAILBOARD

(76) Inventor: Edward A. O'Donnell, 5445 Kee Memorial Dr., Pensecola, FL (US) 32507

( * ) Notice: Subject to any disclaimer, the term of this patent is extended or adjusted under 35 U.S.C. 154(b) by 0 days.

(21) Appl. No.: 10/824,790

(22) Filed: Apr. 16, 2004

(51) Int. Cl.[7] ..... B63B 35/79; B63H 25/06
(52) U.S. Cl. ..... 114/39.12; 114/39.32; 114/162
(58) Field of Search ..... 114/39.12, 39.13, 114/39.14, 39.15, 39.22, 39.25, 39.32, 162

(56) References Cited

U.S. PATENT DOCUMENTS 4,679,516 A 7/1987 Friesen
4,771,723 A 9/1988 Friesen
4,924,791 A 5/1990 Scholle et al.
5,143,008 A 9/1992 Hall
5,170,734 A * 12/1992 Maguerez et al. ..... 114/39.21
5,377,607 A 1/1995 Ross
5,533,462 A 7/1996 Parsons
6,390,013 B1 * 5/2002 Cornell ..... 114/347

* cited by examiner

*Primary Examiner*—Andrew D. Wright

(57) ABSTRACT

A multi-functional sailboard includes a body having a seating section and a dagger. A mast section is connected to the bow of the body and is movable between raised and lowered positions. The mast section includes a stationary mast and a movable mast. The two may be coupled together and slide along a substantially vertical path. The mast section is maintained by a halyard tied to a cleat and a hook and loop fastener is attached to the sail that secures it to the movable mast. A back rest extends upward from the body. A sculling section is secured to the body and includes a traveler, an eye clip, and a cord connected to the eye clip and rudder. The sculling section also includes a spring connected to the rudder and back rest. The rudder returns to an equilibrium position when moved from side-to-side.

11 Claims, 3 Drawing Sheets

MULTI-FUNCTIONAL SAILBOARD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a sailboard and, more particularly, to a sailboard that may be used for windsurfing as well as sailing.

2. Prior Art

Watercraft sports have become increasingly popular particularly in the areas of windsurfing, sculling and more recently sea kayaking. Windsurfing requires good balance, upper body strength as well as a strong back and legs and the ability to stand upright for extended periods of time, thus limiting the number of potential participants in the sport.

Also, depending on wind conditions and sea conditions, windsurfing typically may require several sizes of sails as well as boards, each of which are costly. An active person who engages in such a watercraft sport would need a substantial array of additional equipment to participate, including masts, oars, paddles, and rigging. Sailing requires similar equipment, but rarely does one find a single sailboard that may be used for both sports.

Initially, sailboards were constructed with masts, which were pivotally mounted to the body of the board by a universal joint, which would not support or sustain the mast by itself above the board. Most sailing boards have to be large in size to support the tall masts that accompany them. These sailboards are in widespread use today, but control of the motion of a sailboard having a mast with a universal joint is very difficult to learn and master. Additionally, having a large mast mounted to the board in such away does not allow for easy storage or transportation. Windsurfing boards have the advantage of having a more compact size, which makes them easy to maneuver and transport on top of a vehicle.

Accordingly, a need remains for a sailboard that is suitable for windsurfing as well as sailing and fulfills the equipment requirements for both sports.

BRIEF SUMMARY OF THE INVENTION

In view of the foregoing background, it is therefore an object of the present invention to provide a sailboard that may be used for a variety of watercraft sports. These and other objects, features, and advantages of the invention are provided by a multi-functional sailboard including a buoyant body that has a longitudinal axis and oppositely spaced bow and stern sections. The body has a seating section integral with the bow section and extends rearwardly therefrom along a path substantially parallel to the axis and ending generally medially between the bow and stern sections. The body further includes a dagger extending downwardly therefrom.

The present invention further includes a mast section connected to the bow section of the body that is movable in a substantially linear direction between raised and lowered positions. The mast section advantageously includes an elongated stationary mast, an elongated movable mast disposed proximate to the stationary mast, a plurality of clamps for slidably coupling the movable mast to the stationary mast, and a sail including mechanism for selectively maintaining the mast section at a substantially stable position.

The means for selectively maintaining the mast section at a substantially stable position may include a flexible halyard for hoisting and lowering the sail when same is secured to the movable mast. The means for selectively maintaining the mast section at a substantially stable position may further include a cleat member that has a pair of outwardly projecting horns about which the halyard may be wrapped so that the mast section can be maintained at a substantially stable position. The means for selectively maintaining the mast section at a substantially stable position may further include a zipper member attached to the sail for assisting to maintain the sail about the movable mast.

The present invention further includes a back rest that advantageously extends upwardly from the body and is disposed adjacent the seating section for allowing a user to lean thereagainst during operating conditions. The back rest may include a plurality of vertically oriented support members for suspending the back rest at a predetermined height and a plurality of jam cleats for maintaining a rear portion of the sail at a predetermined position.

The present invention further includes a sculling section secured to the stern of the body for assisting a user to steer and scull the sailboard. The sculling section of the sail board includes a traveler secured to the body including a bar extending thereacross at an elevated position to handle the sheet pulley. The sculling section of the sail board may further include an eye clip secured to the body and on the stern section. The sculling section may also include a cord that has opposed end portions connected to the eye clip and to the rudder handle to thereby twist the rudder and provide a sculling action.

Advantageously, the sculling section may further include a helical spring member that has opposed end portions connected to the rudder handle and to the raised back rest for causing same to be maintained at an elevated position and to return to a central position after it is moved to a lateral position. The sculling section further includes a rudder, preferably a Chinese youloh, which has oppositely disposed gripping and tiller portions as well as a thrust bearing member for operably maneuvering the rudder laterally about the stern section of the sailboard so that a user can steer the tiller portion of the rudder by laterally moving the handle portion under the traveler bar.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
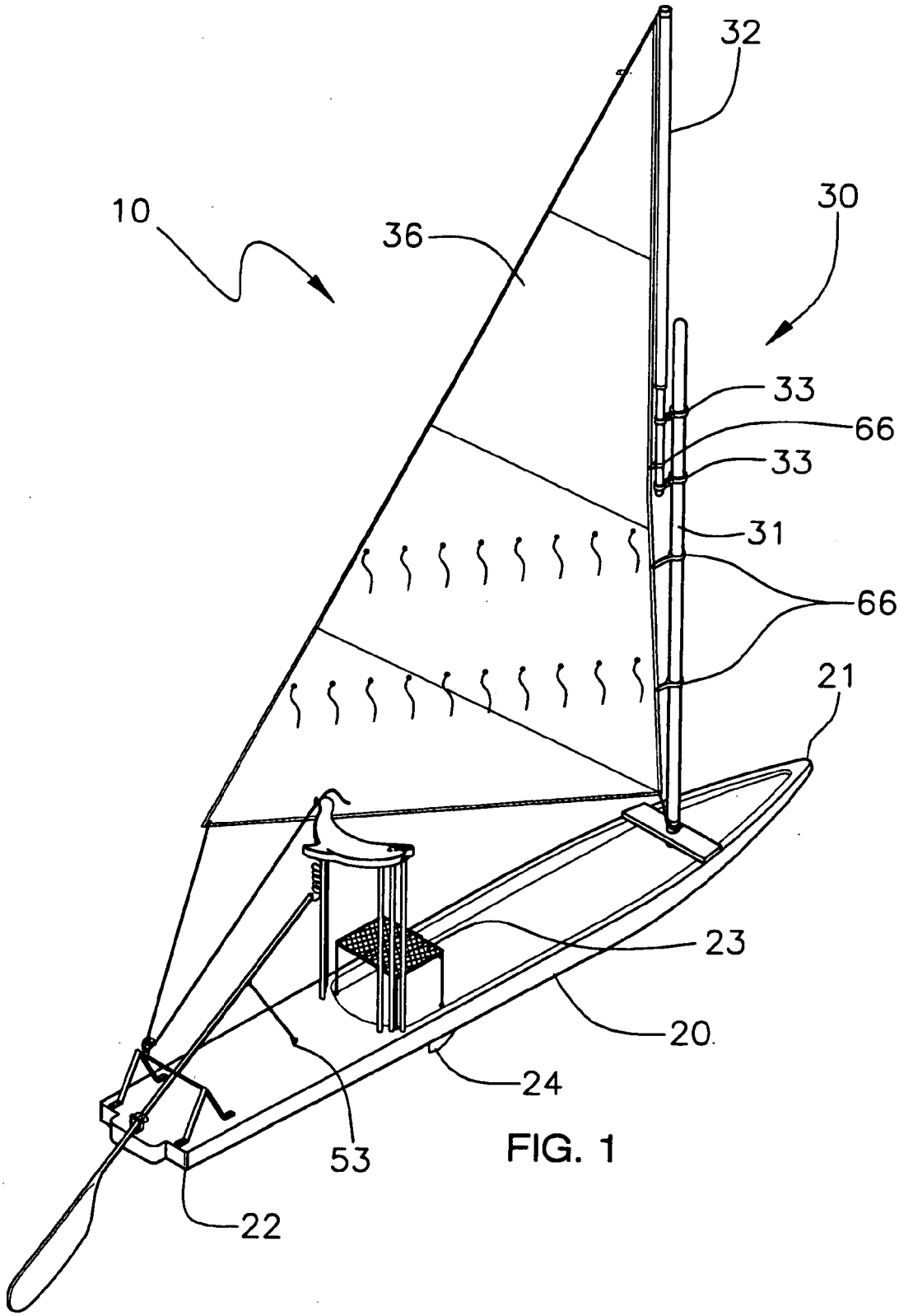
FIG. 1 is a perspective view showing a multi-functional sailboard, in accordance with the present invention.
Figure 3:
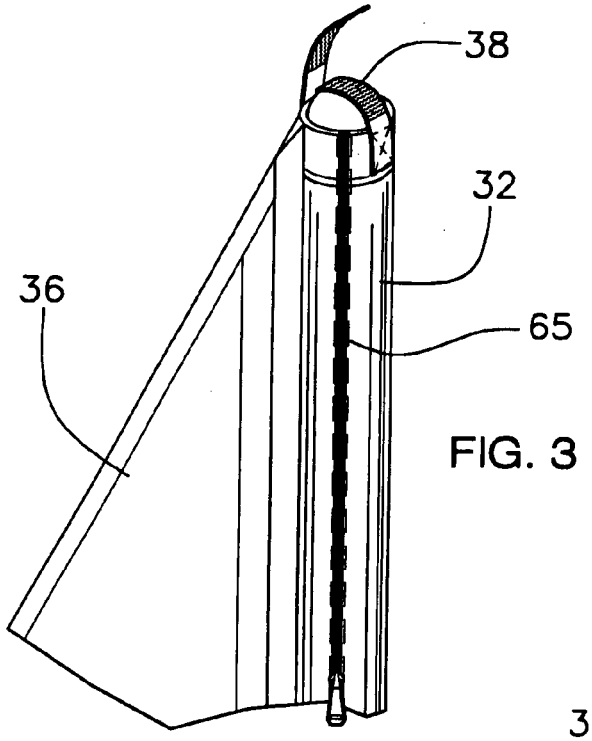
FIG. 3 is an enlarged perspective view showing the sail on the movable mast shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The present invention is referred to generally in FIGS. 1–5 by the reference numeral 10 and is intended to provide a multi-functional sailboard. It should be understood that the device 10 may be used to participate in a variety of watercraft sports.

Referring initially to FIG. 1, the device 10 includes a buoyant body 20 that has a longitudinal axis and oppositely spaced bow 21 and stern 22 sections. The body 20 has a seating section 23. The body 20 further includes a dagger 24 or a metal center board extending downwardly therefrom.

Figure 2:
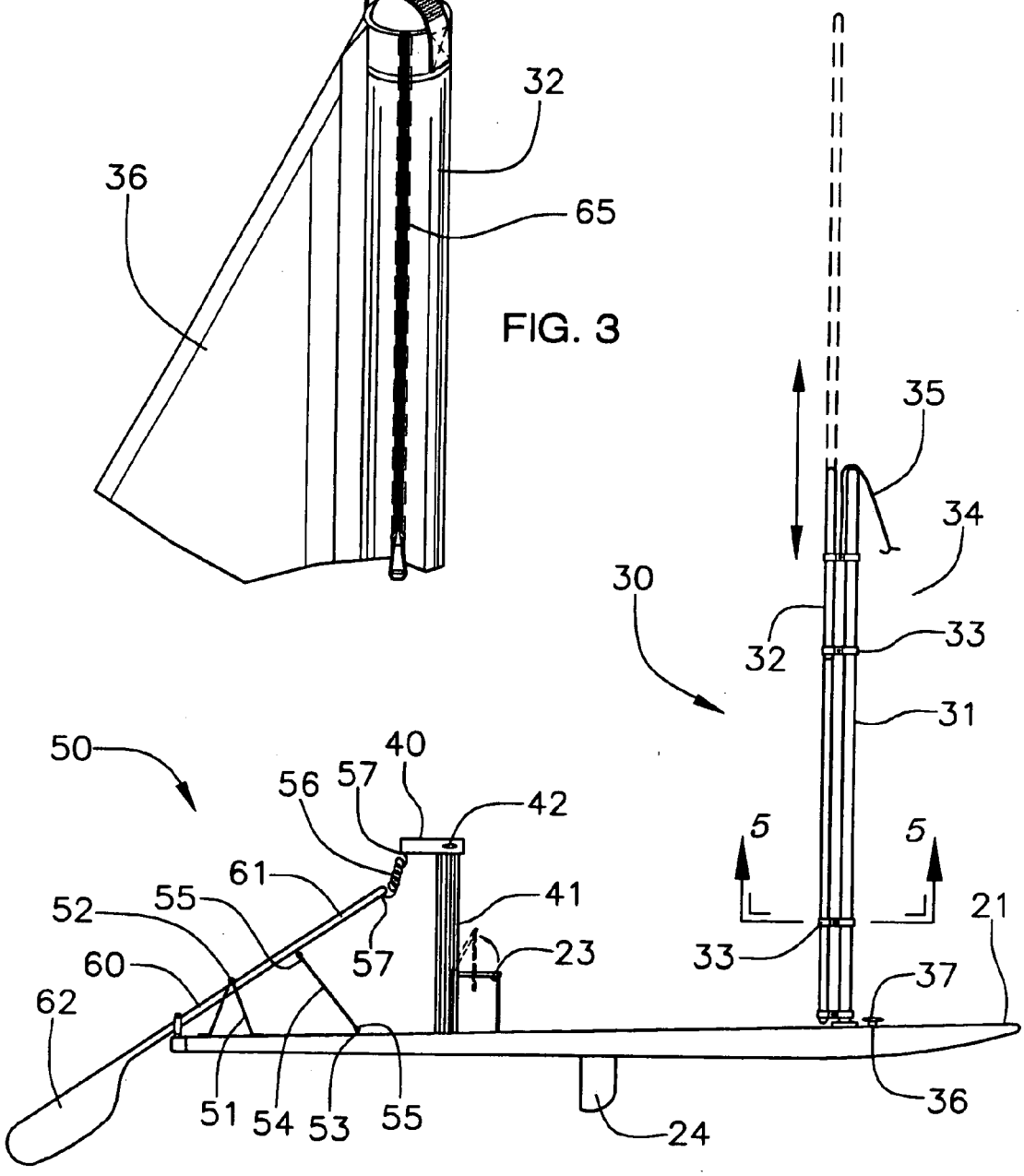
FIG. 2 is side elevational view of the present invention shown in FIG. 1 with the movable top mast in the down position.
Figure 4:
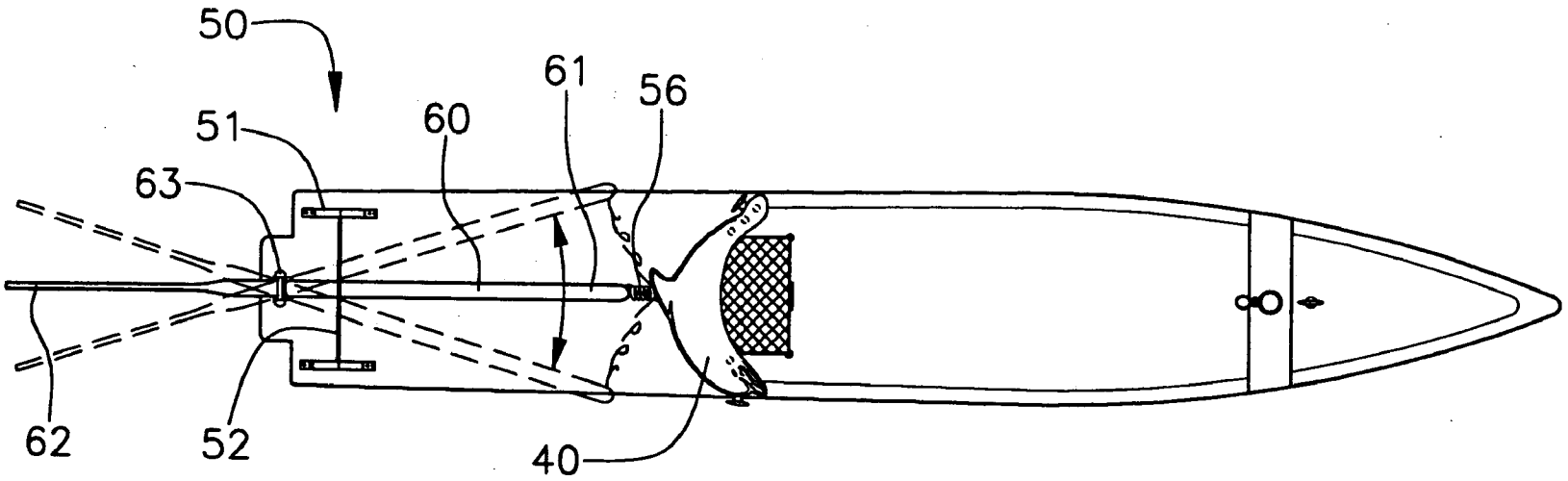
FIG. 4 is a top plan view of the present invention showing the youloh moved between lateral positions.
Figure 5:
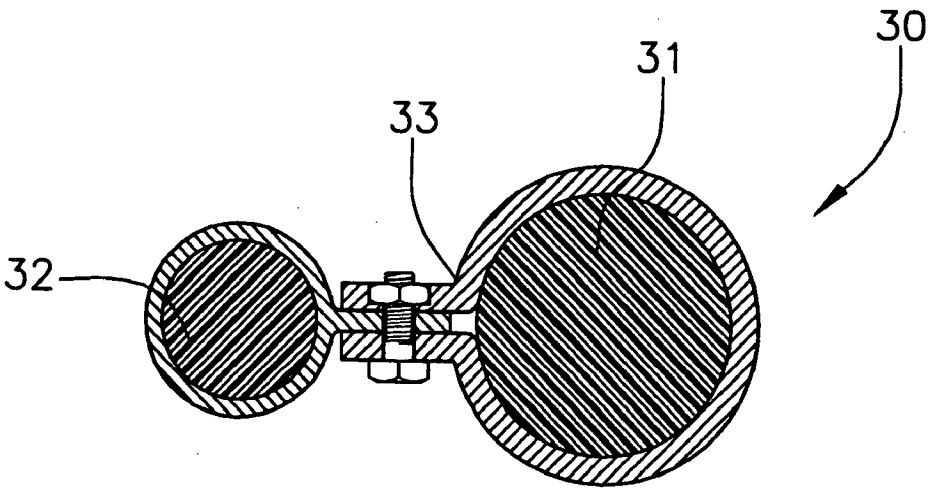
FIG. 5 is an enlarged cross-sectional view of the present invention shown in FIG. 2, taken along line 5—5.

Referring to FIGS. 2 and 5, the present invention further includes a mast section 30 connected to the bow section 21 of the body 20 that is movable in a substantially linear direction between raised and lowered positions. The mast section 30 advantageously includes an elongated stationary mast 31, an elongated movable mast 32 disposed proximate to the stationary mast 31, a plurality of clamps 33 for slidably coupling the movable mast 32 to the stationary mast 31, and a sail including mechanism 34 for selectively maintaining the mast section 30 at a substantially stable position.

The means for selectively maintaining the mast section at a substantially stable position 34 includes a flexible halyard 35 for hoisting and lowering the sail 36 when same is secured to the movable mast 32. The means for selectively maintaining the mast section at a substantially stable position 34 further includes a cleat member 36 that has a pair of outwardly projecting horns 37 about which the halyard 35 may be wrapped so that the mast section 30 can be maintained at a substantially stable position. The means for selectively maintaining the mast section at a substantially stable position 34 further includes a hook and loop fastener 38, such as VELCRO, attached to the sail 36 for assisting to lower the sail 36 secured to the movable mast 32, as perhaps best shown in FIG. 3. Of course, other conventional fastening members may be employed without departing from the true scope of the scope of the invention. Once sailing action is completed for the day, the sail 36 may be lowered by releasing the hook and loop fastener 38. Once the mast section 30 is disconnected and the sail 36 rolled up, the present invention may be easily transported atop a car or trailer.

Referring back to FIG. 2, the present invention further includes a back rest 40 that advantageously extends upwardly from the body 20 and is disposed adjacent the seating section 23 for allowing a user to lean thereagainst during operating conditions. The back rest 40 includes a plurality of vertically oriented support members 41 for suspending the back rest 40 at a predetermined height and a plurality of jam cleats 42 for maintaining a rear portion of the sail 36 at a predetermined position. The sail 36 has a zipper 65 along the top sleeve and three awning spring clips 66 for quick sail removal and installation.

Referring back to FIG. 4, the present invention further includes a sculling section 50 secured to the stern 22 of the body 20 for assisting a user to steer the sailboard. The sculling section 50 includes a traveler 51 secured to the body 20 including a bar 52 extending thereacross at an elevated position. The sculling section 50 further includes an eye clip 53 secured to the body 20 and adjacent the stern section 22. The sculling section 50 also includes a cord 54 that has opposed end portions 55 connected to the eye clip 53 and to the rudder 60 to thereby twist the rudder or Youloh blade 60 for providing sculling action with lateral motion, best shown in FIG. 2.

Advantageously, the sculling section 50 further includes a helical spring member 56 that has opposed end portions 57 connected to the rudder 60 and to the back rest 40 for causing the rudder 60 to be maintained at an elevated position and to return to a central position after it is moved to lateral positions. The sculling section 50 further includes a rudder 60, preferably a Chinese youloh, which has oppositely disposed gripping 61 and blade 62 portions as well as a thrust bearing member 63 for operably maneuvering the rudder 60 about the stern section 22 of the sailboard so that a user can steer the blade portion 62 of the rudder 60 by selectively moving the gripping portion 61 under the traveler bar 52, best shown in FIG. 4. The spring member 56 pulls the gripping portion 61 up as it travels to each side. This provides a level of control and efficiency to an otherwise tiresome sculling activity.

Many people avoid sailing because of the danger or difficult level of skill it requires. The present invention makes both sailing and windsurfing safe and easy sports to learn. The design of the board is very hydrodynamic, which allows it to cut through the water with ease and balance. The Chinese youloh design of the steering mechanism allows a user to enjoy sailing without becoming worn out from operating the rudder. There are those people that are already involved in such a sport but do not regularly participate because their craft is too big to transport and most remain at an unguarded locale. Such a person would benefit from being able to transport the present invention to different locales and then safely home.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A multi-functional sailboard comprising:

a buoyant body having a longitudinal axis and oppositely spaced bow and stern sections, said body including a seating section integral with said bow section and extending rearwardly therefrom along a path substantially parallel to the axis and ending generally medially between the bow and stern sections, said body further including a dagger extending downwardly therefrom;

a mast section connected to said bow section of said body and being movable in a substantially linear direction between raised and lowered positions, said mast section comprising:

an elongated stationary mast, an elongated movable mast disposed proximate to said stationary mast, a plurality of clamps for slidably coupling said movable mast to said stationary mast, and a sail comprising means for selectively maintaining said mast section at a substantially stable position, a back rest extending upwardly from said body and being disposed adjacent said seating section for allowing a user to lean thereagainst during operating conditions; and a sculling section secured to said stern section of said body and for assisting a user to steer said sailboard, said sculling section comprising:

a traveler secured to said body and including a bar extending thereacross at an elevated position, and a rudder having oppositely disposed gripping and tiller portions and comprising a bearing member for operably maneuvering said rudder about said stern section of said sailboard so that a user can steer said tiller portion of said rudder by selectively moving said gripping portion under said bar.

2. The multi-functional sailboard of claim 1, wherein said mast section maintaining means comprises:

a flexible halyard for hoisting and lowering said sail and being secured to said movable mast; and a cleat member having a pair of outwardly projecting horns about which said halyard may be wrapped so that said mast section can be maintained at a substantially stable position.

3. The multi-functional sailboard of claim 2, wherein said mast section maintaining means further comprises:

a hook and loop fastener is attached to said sail for assisting to lower said sail secured to said movable mast.

4. The multi-functional sailboard of claim 1, wherein said sculling section further comprises:

a helical spring member having opposed end portions connected to said rudder and to said back rest for causing said rudder to return to a central position after being moved to a lateral position.

5. The multi-functional sailboard of claim 1, wherein said back rest comprises:

a plurality of vertically oriented support members for suspending said back rest at a predetermined height; and a plurality of cleats for maintaining a rear portion of said sail at a predetermined position.

6. The multi-functional sailboard of claim 1, wherein said sculling section further comprises:

an eye clip secured to said body and adjacent said stern section; and a cord having opposed end portions connected to said eye clip and to said rudder.

7. A multi-functional sailboard comprising:

a buoyant body having a longitudinal axis and oppositely spaced bow and stern sections, said body including a seating section integral with said bow section and extending rearwardly therefrom along a path substantially parallel to the axis and ending generally medially between the bow and stern sections, said body further including a dagger extending downwardly therefrom;

a mast section connected to said bow section of said body and being movable in a substantially linear direction between raised and lowered positions, said mast section comprising an elongated stationary mast, an elongated movable mast disposed proximate to said stationary mast, a plurality of clamps for slidably coupling said movable mast to said stationary mast, and a sail comprising means for selectively maintaining said mast section at a substantially stable position, a back rest extending upwardly from said body and being disposed adjacent said seating section for allowing a user to lean thereagainst during operating conditions; and a sculling section secured to said stern section of said body and for assisting a user to steer said sailboard, said sculling section comprising:

a traveler secured to said body and including a bar extending thereacross at an elevated position, said traveler for allowing a pulley to glide from slide-to-slide for maintaining said sail at a select position, and a rudder having oppositely disposed gripping and tiller portions and comprising a bearing member for operably maneuvering said rudder about said stern section of said sailboard so that a user can steer said tiller portion of said rudder by selectively moving said gripping portion under said bar, and a helical spring member having opposed end portions connected to said rudder and to said back rest for causing said rudder to return to a central position after being moved to a lateral position.

8. The multifunctional sailboard of claim 7, wherein said mast section maintaining means comprises:

a flexible halyard for hoisting and lowering said sail and being secured to said movable mast; and a cleat member having a pair of outwardly projecting horns about which said halyard may be wrapped so that said mast section can be maintained at a substantially stable position.

9. The multi-functional sailboard of claim 8 wherein said mast section maintaining means further comprises:

a hook and loop fastener attached to said sail for assisting to maintain said sail secured to said movable mast.

10. The multi-functional sailboard of claim 7, wherein said back rest comprises:

a plurality of vertically oriented support members for suspending said back rest at a predetermined height; and a plurality of cleats for maintaining a rear portion of said sail at a predetermined position.

11. The multi-functional sailboard of claim 7, wherein said sculling section further comprises:

an eye clip secured to said body and adjacent said stern section; and a cord having opposed end portions connected to said eye clip and to said rudder.

* * * * *